US007355555B2

(12) United States Patent
Kitchener et al.

(10) Patent No.: US 7,355,555 B2
(45) Date of Patent: Apr. 8, 2008

(54) ANTENNA

(75) Inventors: Dean Kitchener, Brentwood (GB); Andrew Urquhart, Bishops Stortford (GB); David Adams, Chelmsford (GB)

(73) Assignee: Nortel Networks Limited, St. Laurent, Quebec (CA)

( * ) Notice: Subject to any disclaimer, the term of this patent is extended or adjusted under 35 U.S.C. 154(b) by 168 days.

(21) Appl. No.: 11/225,520

(22) Filed: Sep. 13, 2005

(65) Prior Publication Data

US 2007/0057859 A1 Mar. 15, 2007

(51) Int. Cl.
*H01Q 13/10* (2006.01)

(52) U.S. Cl. ..... 343/770

(58) Field of Classification Search ..... 343/770, 343/789, 767, 771

See application file for complete search history.

(56) References Cited

U.S. PATENT DOCUMENTS 2,756,421 A * 7/1956 Harvey et al. ..... 343/770
2,947,988 A * 8/1960 Masters ..... 343/742
5,220,337 A * 6/1993 Ajioka ..... 343/770
5,546,096 A * 8/1996 Wada ..... 343/771
5,929,821 A * 7/1999 Goldstein et al. ..... 343/770
6,137,448 A * 10/2000 Schadler ..... 343/770
7,091,918 B1 * 8/2006 Bhansali et al. ..... 343/767
7,205,952 B2 * 4/2007 Harris ..... 343/791
2003/0080913 A1 * 5/2003 Harris ..... 343/770

* cited by examiner

*Primary Examiner*—Huedung Mancuso
(74) *Attorney, Agent, or Firm*—Barnes & Thornburg LLP

(57) ABSTRACT

An antenna array may be constructed using a plurality of tubes of electrically conducted material in conjunction with an additionally electrically conductive component which covers the front faces of tubes and at least part of the sides. Between the structures, a further electrically conductive material may be placed separated by dielectric material, and may be used to provide radiating elements and a feed structure by producing stripline structures. This structure is thereby able to reduce cavity back slots fed with triplate stripline along the sides of the tubes. This structure, particularly when made from plastics material, is low in complexity and cost and lightweight. These features overcome many of the disadvantages of the existing designs.

38 Claims, 6 Drawing Sheets

ANTENNA

FIELD OF THE INVENTION

This invention relates to array antennas and in a preferred embodiment, to multipolar arrays.

BACKGROUND OF THE INVENTION

Array antennas, having a plurality of radiating elements, are increasingly used in adaptive and/or multibeam applications. They are expected to be an important element of future broadband wireless solutions since such antennas enable significant capacity gains to be produced, for example, using accurate beam steering and beam forming.

However, since the amplitude and phase weights of the array elements need to be accurately controlled in order to generate the desired beam patterns, the feed networks of such antennas are complex which means that the antennas are generally expensive to produce. In addition, they generally require multiple rows and columns, resulting in large structures with many piece parts, which are heavy.

With increasing use of such antennas it will become necessary to reduce complexity of manufacture in order achieve a reduction in cost. In order to allow easy mounting of such antennas and to reduce the cost of installation, it is also desirable to reduce the weight of such antennas.

Hitherto, antennas of this type have typically been formed using discrete dipole antennas mounted adjacent a planar reflector. The feed to each antenna has been achieved using a network of coaxial cables. Alternative structures also exist which employ microstrip patch elements and microstrip feed networks.

SUMMARY OF THE INVENTION

In a first aspect, the invention provides an antenna comprising an electrically conductive tube, an electrically conductive outer surface covering a front face and at least part of the two adjacent side faces of the tube, a feed layer located between the tube and the outer surface and arranged to carry electrically conductive tracks, and dielectric material located between the tube and the feed layer and between the outer surface and the feed layer, the antenna further comprising a plurality of radiating elements formed as slots defined by areas of non-conductivity in the front face of the outer surface and in the tube which are in registry with one another and respective conductive tracks defined on the feed layer which are generally in registry with the slots.

The components may, for example be made from plastics mouldings with an electrically conductive coating. This provides a very lightweight structure.

It will be noted that the feed layer is sandwiched between two conductive components which forms a triplate, type feed network. This obviates the need for complex and heavy feed networks using coaxial cables.

By arranging a plurality of the tubes side by side, a further set of radiating elements may be provided so that an array may be made up in a modular fashion using as many tubes as are required. The tubes may share the common parts of the outer surface as described below.

By varying the orientation of the slots, it is possible to achieve different polarisations and/or multiple polarisations from the same antenna. This is described in detail below.

In a preferred embodiment, slots are oriented at plus and minus 45 degrees and are interspersed so that the array provides plus and minus 45 degree polarised radiation.

With suitable choices of plastics, the antenna may be constructed without a radome; further reducing cost and weight.

The outer surface may have a curved profile. This typically increases strength of the tube and may be used also to further tailor the spatial variation of the antenna pattern. This structure also has the advantage that it need not be necessary to turn the feed layer through sharp corners.

In a second aspect, the invention provides a multibeam antenna comprising a generally cylindrical electrically conductive outer layer, a plurality of electrically conductive tubes arranged around the central axis of the cylinder, an electrically conductive inner cylindrical layer forming the outermost wall of each tube, and a feed layer located between the inner and outer layers and arranged to carry electrically conductive tracks, and dielectric material located between the outer layer and the feed layer and between the inner layer and the feed layer, the antenna further comprising a plurality of radiating elements formed as slots defined by areas of non-conductivity in the outer layer and in the inner layer which are in registry with one another and respective conductive tracks defined on the feed layer which are generally in registry with the slots, whereby each tube generally corresponds to a single respective beam of the antenna.

This arrangement has particular application in cellular networks such as cellular telephone networks. The tubes may be arranged singly or in multiple arrays to provide, for example, three beams spaced generally equally around the cylinder. This provides a particularly effective and economical antenna.

In a third aspect, the invention provides an antenna component comprising an electrically conductive tube, an electrically conductive outer surface covering a front face and at least part of the two adjacent side faces of the tube, a feed layer located between the tube and the outer surface and arranged to carry electrically conductive tracks, and dielectric material located between the tube and the feed layer and between the outer surface and the feed layer, the antenna further comprising a radiating element formed as a slot defined by areas of non-conductivity in the front face of the outer surface and in the tube which are in registry with one another, the slot being energized in use by a conductive track defined on the feed layer which is generally in registry with the slots.

This module, may be used as a building block for the antennas of the other aspects. With a baffle at one or both ends, it forms a single cavity-backed slot component. Other aspects and features of the present invention will become apparent to those ordinarily skilled in the art upon review of the following description of specific embodiments of the invention in conjunction with the accompanying figures.

DETAILED DESCRIPTION OF THE INVENTION

Figure 1:
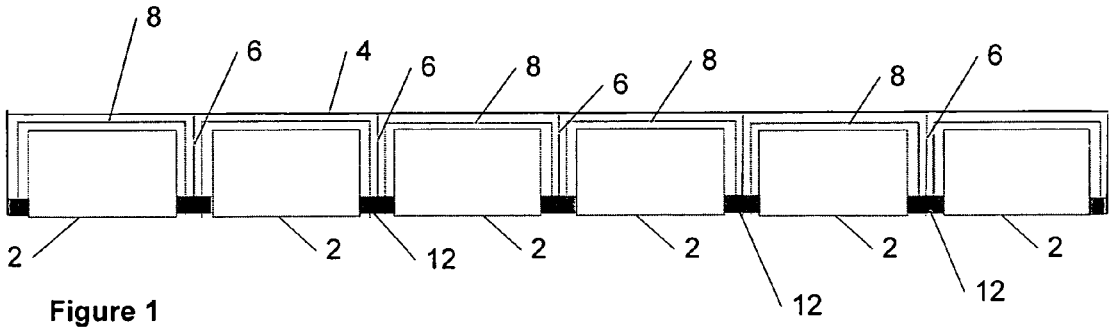
FIG. 1 is a cross-section through an antenna array having six columns in accordance with the invention.

With reference to FIG. 1, a plurality of tubes 2 extend generally vertically into and out of the plane of the drawing. Typically the tubes are formed from a plastics material with a metallized coating. Alternatively, the tubes could be formed from metal. Although shown as generally rectangular, these tubes could have any cross-sectional shape consistent with the desired electrical performance of the antenna.

An electrically conductive outer surface 4 formed, for example, from metal film or metallized plastic spreads across the front, covering the front faces of the tubes 2. This component is ribbed and has ribs 6 extending rearwardly between the tubes 2.

A feed layer 8 typically formed from flexible film such as mylar, extends between the outer surface 4 and the tubes 2. This film contains conductive stripline elements which excite the radiating slots and also form a feed network as described below.

Figure 2:
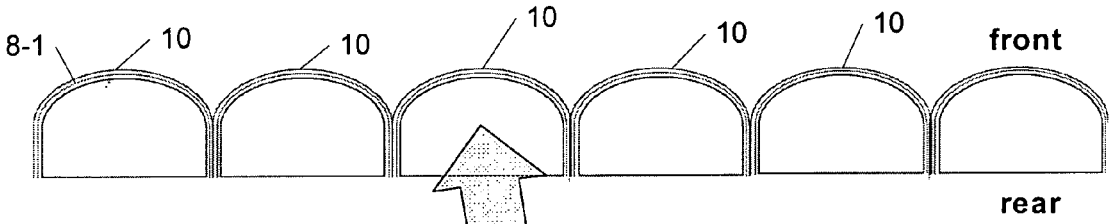
FIG. 2 is a cross-section through an alternative embodiment of an array in accordance with the invention.
Figure 2A:
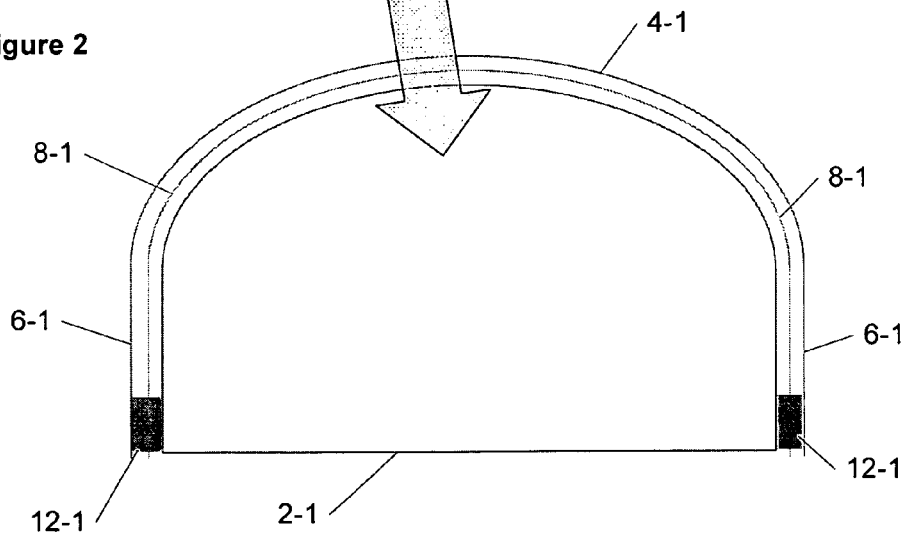
FIG. 2A is an enlarged cross-section of a portion thereof.

FIG. 2 shows an alternative embodiment in which the tubes and the outer surface have radiused portions 10 generally at the front of the antenna array. An enlarged view of each of the curved modules is shown in FIG. 2A. Like components are labelled using the same reference numerals as FIG. 1 with the suffix-1.

In a further alternative embodiment (not shown), the outer surface 4 of FIG. 2 may be generally planar whilst the feed layer 8-1 may either follow the planar contour of the outer surface or the curved contour of the front face of the tube 2-1.

In both cases, edge connectors 12, 12-1 are formed at the rear end of the array to allow connection to the feed layer and also to allow grounding of the tubes 2, 2-1 and front surface 4, 4-1.

As will be described in more detail below, the conductive surfaces of the front surface 4 and the tubes 2 are interrupted to create non-conductive slots. Typically, a T bar radiator is formed at the same position in the feed network. This construction therefore provides a cavity backed, slot radiating element and a triplate (i.e. stripline tracks between ground plates) feed network along the ribs, 6, 6-1. This provides particularly compact construction. Furthermore, when made of plastics material, the antenna is both light and resistant to water ingress and corrosion. Thus the antenna need not be provided with a separate radome. However as described below, some embodiments may have slots passing entirely through the components (rather than merely having the conductive surface removed) and thus a separate radome may be desirable in those cases to avoid water ingress.

Figure 3:
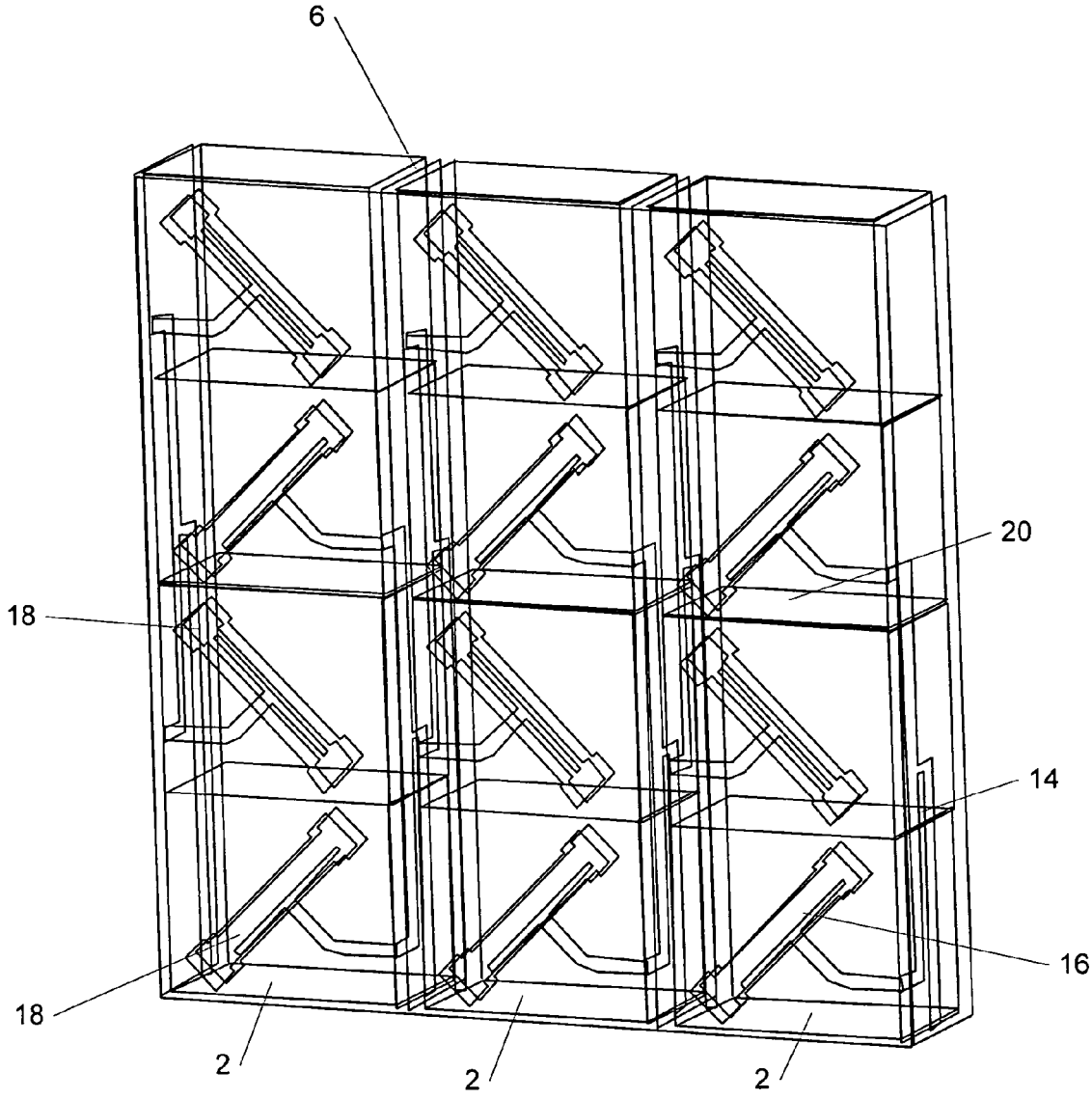
FIG. 3 is a perspective and partially cut away view of a portion of a dual-polar array in accordance with the invention.

With reference to FIG. 3, a partially cut away and perspective view of a portion of an array constructed generally in accordance with FIG. 1 is shown. FIG. 3 shows three tubes 2 oriented vertically and arranged side by side. The feed layer carries the feed network 14 along the rearwardly extending ribs 6 of the structure. The ribs 6 may extend back as far as is required in order to accommodate the stripline feed network.

The figure shows slots in adjacent columns have slots of the same orientation in each row of the array. An alternative arrangement is to ensure that the adjacent slots of adjacent tubes are at different polarisation angles, for example, by alternating the slot orientation along a row i.e. across the tubes. This might reduce coupling between adjacent slots.

The feed network terminates in a T bar located in each respective slot, which matches the feed network to the slot and also excites it causing it to radiate. The slots are formed by removing metallization or forming an aperture through the entire material of the tubes and front face. It will be noted that the slots 18 are oriented in different directions. In this case the directions are plus and minus 45 degrees in relation to the axis of each of the tubes 2. These orientations allow the antenna array to operate in a dual polar mode and it will be noted that the feed networks for each of the alternately oriented slots pass along opposite sides of the tubes 2. This separation of the feed networks is not essential but aids layout of the feed network and makes best use of the available space.

It will be appreciated that the array shown may extend in any direction by extending the length of the tubes 2 and/or by adding additional tubes and that angles other than 45 degrees may be selected for the slots for different desired polarisation angles and that the polarisation angles need not be orthogonal.

As the height of the array increases, additional branches of the feed network are required. The space for this may readily be accommodated simply by extending the rib 6 further back into the plane of the page as drawn.

Typically the horizontal spacing between slots is $\lambda/2$ where $\lambda$ is the designed operating wavelength of the antenna. Also, the typical vertical spacing between slots of the same orientation is approximately $0.8\lambda$. Thus in the embodiment shown, with alternating orientations of slots, each of the cavities behind the slots is approximately $\lambda/2$ wide by $0.4\lambda$ high. The cavity depth is approximately $\lambda/4$. Optionally, baffles 20 may be inserted across the tubes in order to reduce coupling between the slots and T bar elements of differing polarisations.

It will be noted that the spacing of the slots may vary. For example, the array may be arranged for scanning of beams in the vertical plane. In that case, a horizontal spacing of about $0.8\lambda$ and a vertical spacing of about $\lambda/2$ would be desirable. This may be achieved by rotating the array through 90 degrees; so having the tubes running horizontally, or alternatively by making the tubes wider (to achieve the wider horizontal spacing) and decreasing the spacing between slots in each tube. It will be appreciated that many other variations are possible and will generally be dictated by the desired beam patterns and adjustability requirements of the antenna.

In this preferred embodiment, the slots also have a "dog bone" configuration with wider portions at the ends of the slots. This allows better control of the resonant frequency whilst keeping the physical slot length shorter than otherwise would be the case. It is anticipated that without the dog bone configuration, these slots lengths would approach $\lambda/2$. This length may, for example, be reduced to $0.45\lambda$ with the use of the dog bone configuration; thereby improving the space efficiency of the antenna.

Considering again the arrangement of FIG. 2, it will be noted that curving the structure may improve strength but may also be used to allow the feed layer to more smoothly be turned around corners. Furthermore, the curving and potential presence of additional thicknesses of materials may be used to further tune the characteristics of the antenna.

Figure 4:
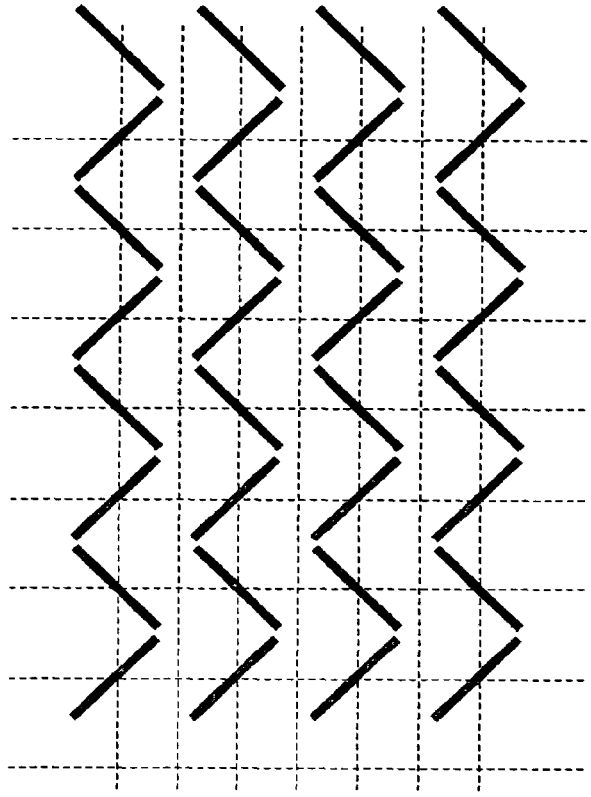
FIG. 4 is a schematic diagram showing a possible arrangement of radiating elements for a dual-polar array.

FIG. 4 shows schematically the arrangement of slots shown in FIG. 3.

Figure 5:
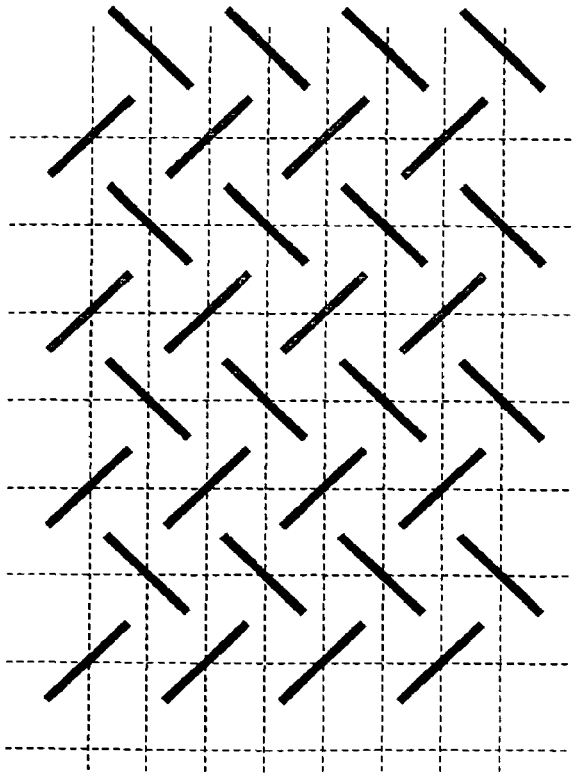
FIG. 5 is a further alternative embodiment showing a possible slot arrangement for a dual-polar array.

FIG. 5 shows an alternative embodiment in which the slots are offset between columns of the array. This provides more efficient use of space.

It will be noted that the cavities behind the slots are offset from the vertical axis. Thus this arrangement may be constructed, for example, by forming each cavity as a separate unit and assembling the array from separate cavities and weaving the feed layer between the cavities. Alternatively, each tube may be formed as a stepped arrangement with each alternate cavity offset to one side or the other. The term 'tube' as used in the present application is intended to encompass such a stepped arrangement.

Figure 6:
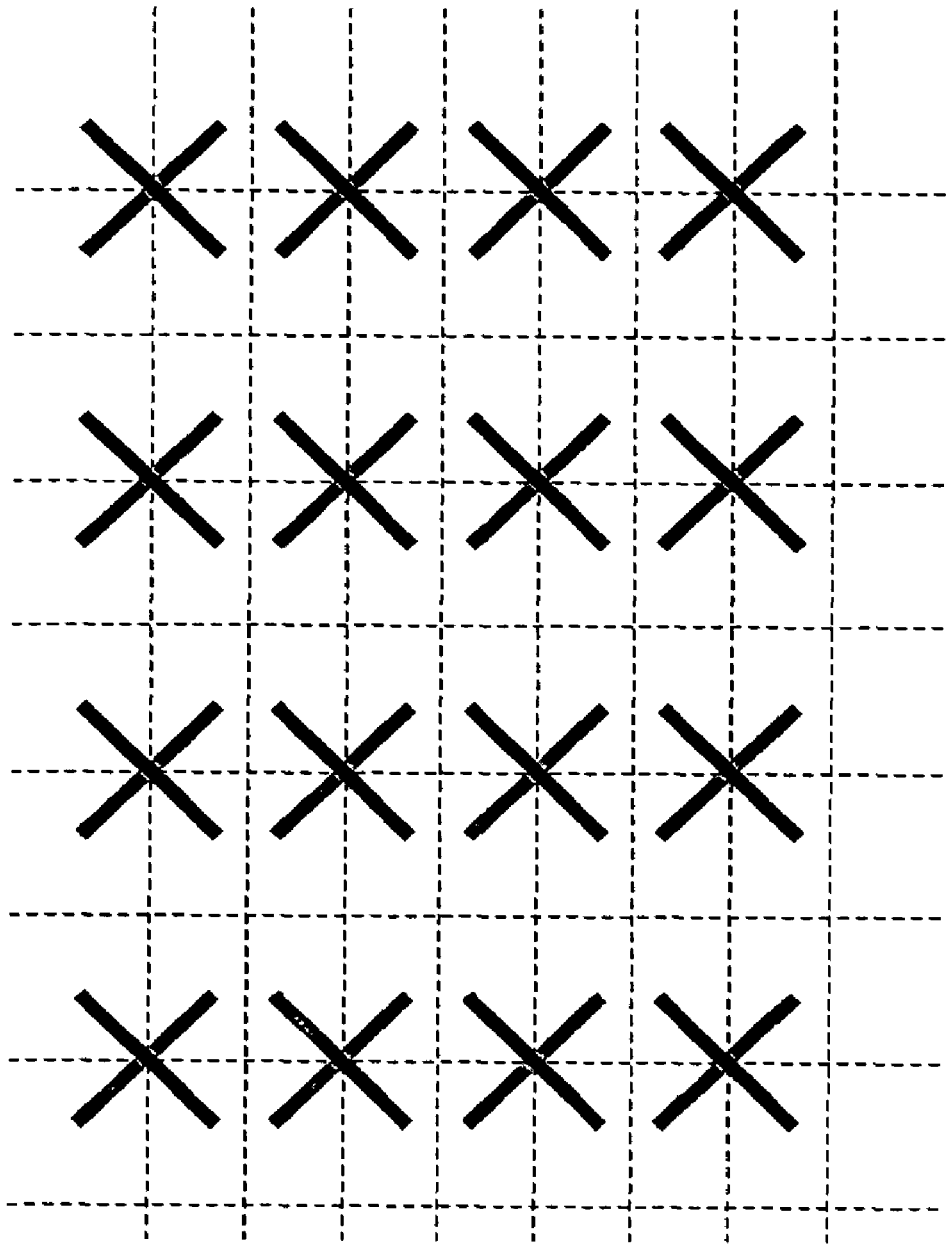
FIG. 6 is a further possible arrangement for slots in a dual-polar array in accordance with the invention.

FIG. 6 shows a further alternative embodiment in which the slots overlap and form a crossed structure. It will be noted that the feed networks, however, must remain separate in this instance and thus the central T bar feed would need to be varied in order to achieve this configuration.

Other configurations are within the scope of this invention.

Figure 7:
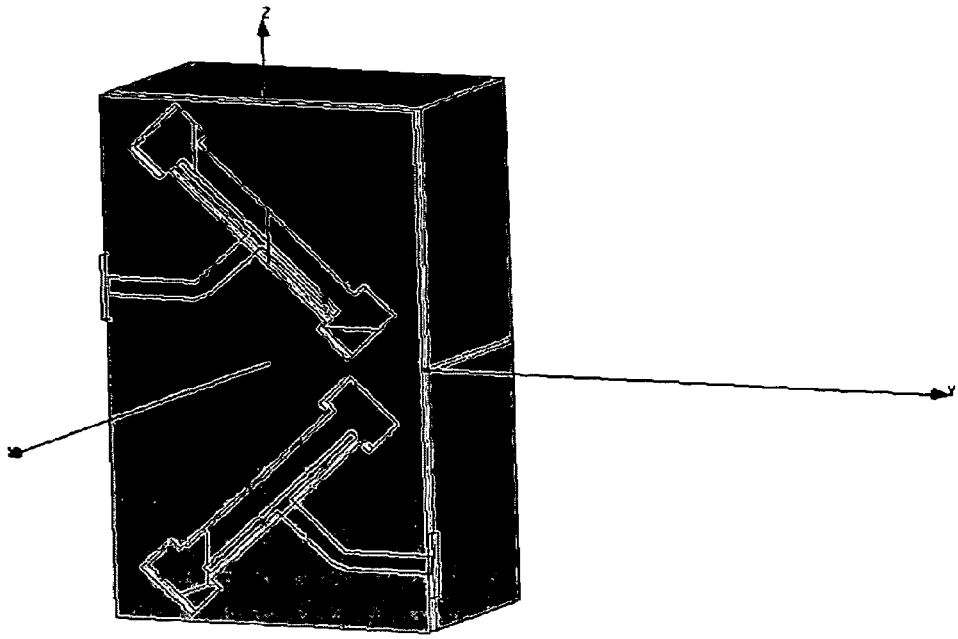
FIG. 7 shows a detail of a pair of slots.
Figure 8:
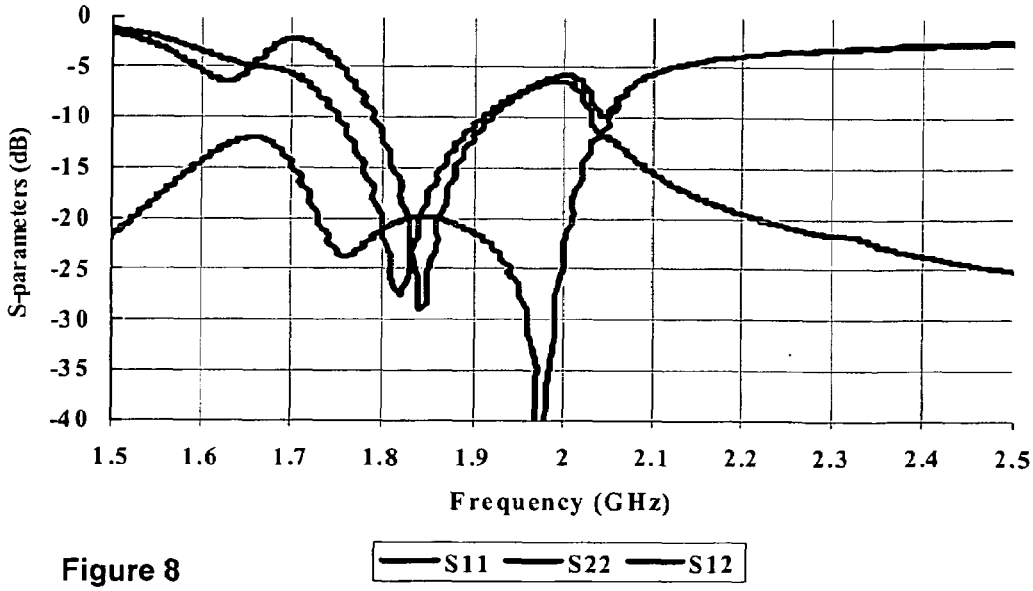
FIG. 8 shows an S-parameter plot of the slots of FIG. 7.

FIG. 7 shows a small section of the array of FIG. 3. This small section has been modeled for a particular application in which it is desired to have an operating band typically in the band 1.85 to 1.99 GHz. Accordingly the center frequency was taken to be 1.92 GHz. With the configuration shown in the drawing with a T bar length of 50 mm, located 2.5 mm from the edge of each slot, with a slot length of 68.25 mm and with two 9 mm extensions forming the dog bones, the S plot shown in FIG. 8 was achieved.

The slot width is approximately 0.7λ which is about 1 cm at 2GHz. As will be seen, a 10 dB return loss for the two slots occurs in the band 1.83 to 2.01 GHz and 1.86 to 2 GHz respectively. Mutual coupling between the slots is less than −20 dB. Tuning of the length of the slots, the width of the dog bones, the width and length of the T bar and the positioning of the T bar may be used to adjust the performance of the antenna. Arrangements other than T-bars may also be used. Furthermore, a baffle as described above, has been inserted between the two slots in order to reduce coupling therebetween.

Thus the array described above may be used in single columns or multiple columns to provide a static beam of well defined shape and direction (with a static feed network) or a steerable and adaptive beam of variable beam shape and/or direction depending on the phase and gain of the feed network fed to each of the slot radiators.

Figure 9:
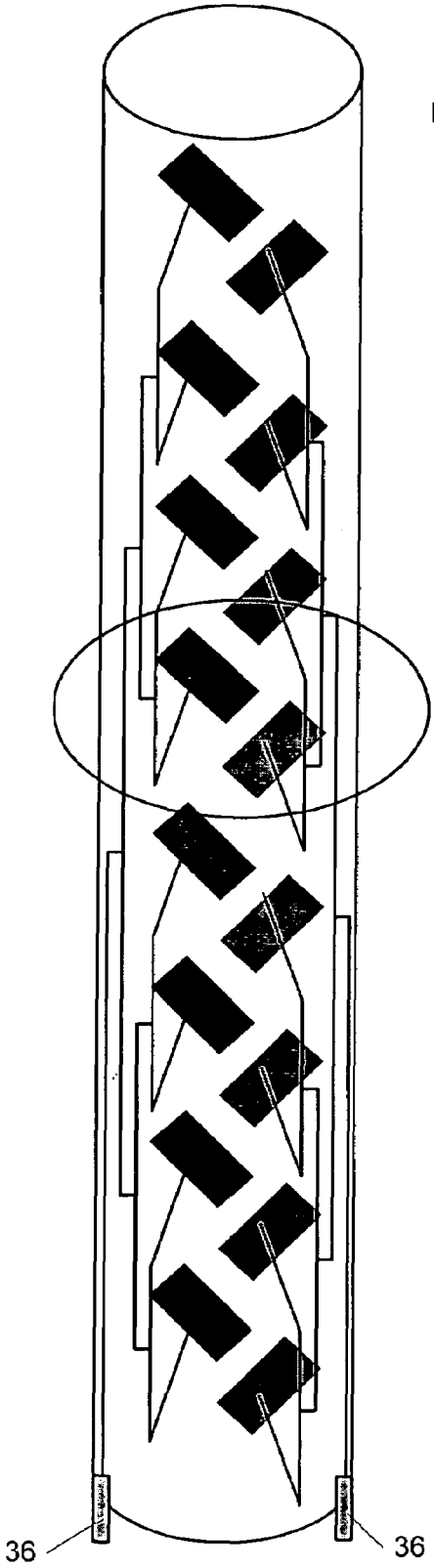
FIG. 9 shows an elevation of a multibeam antenna in accordance with the present invention.
Figure 10:
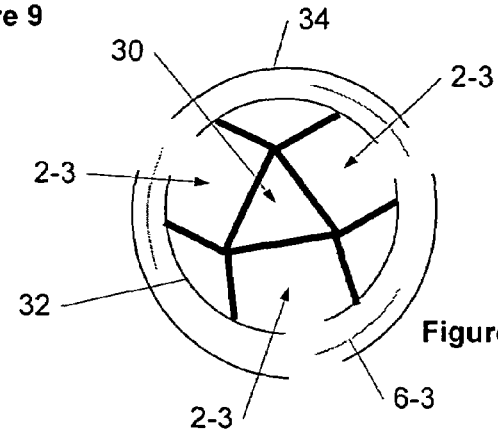
FIG. 10 is a sectional view of the antenna of FIG. 9.

In an alternative embodiment as shown in FIGS. 9 and 10, the columns formed by each of the tubes and associated components described above, may be mounted around a central axis 30. The tubes 2-3 are generally similar in construction to those described above and have a feed layer 6-3 sandwiched between the front faces of the tubes 2-3 which generally form an inner cylinder 32 and an outer cylinder 34 the outer cylinder 34 is generally equivalent to the front surface 4 shown in FIG. 1.

Figure 11:
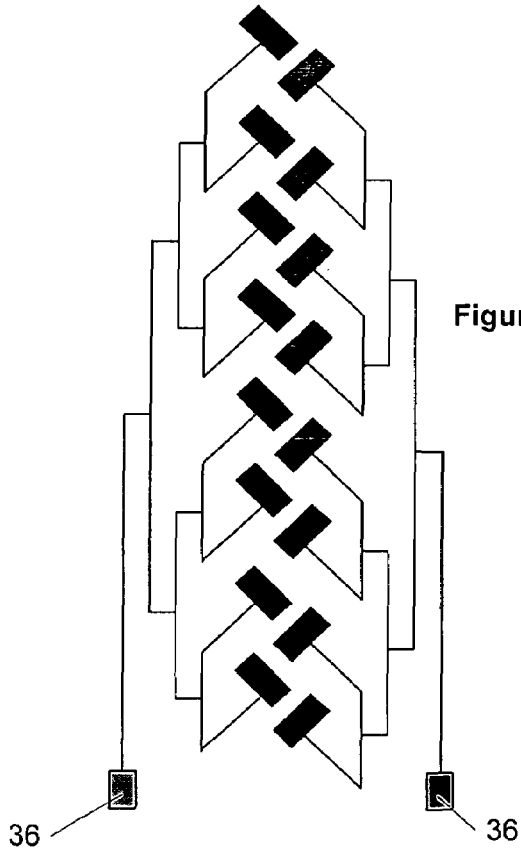
FIG. 11 is a detail of a possible feed network for the antenna of FIGS. 9 and 10.

Slots are formed through both the cylinders in the same way as described above and are shown in FIG. 9 in particular. A schematic feed network is shown, for example, in FIG. 11. In the same way as described above, edge connectors 36 may be formed at the base of the columns and these may for example be formed by moulding the plastic into the shape of conventional connectors and coating in a conductive material.

With particular reference to FIG. 10, it will be noted that this arrangement provides the ability to direct beams in three different directions from a single cylindrical antenna structure. This type of beam pattern is often required for cellular telephone applications in which a single mast may accommodate three different sectors and may divide the sectors by using well defined radiation patterns. In general, pairing of tubes 2-3 provides a narrower beam pattern. Thus although the drawings show a single column, it will be appreciated that multiple columns may be joined together in the same way as the array described above to provide the possibility of better defined radiation patterns. This may be achieved simply by increasing the diameter of the cylinder to allow room for additional columns to be contained therein. This configuration has all the advantages described above particularly when made from plastics material, of lightweight and simple construction. Also, the configuration provides little, if any, performance degradation over existing designs.

What is claimed is:

1. An antenna comprising an electrically conductive tube forming a backing cavity, the electrically conductive tube including a front face and two side faces extending from the front face, an electrically conductive outer surface covering the front face of the tube and at least part of the two side faces of the tube, a feed layer located between the tube and the outer surface and arranged to carry electrically conductive tracks, and dielectric material located between the tube and the feed layer and between the outer surface and the feed layer;

the antenna further comprising a plurality of radiating elements, each radiating element being formed as a slot defined by an area of non-conductivity in the front face of the outer surface and in the tube which are in registry with one another, each slot being an area of non-conductivity energized in use by a conductive tracks defined on the feed layer which is generally in registry with the slot.

2. An antenna according to claim 1, wherein the dielectric material is selected from the group containing air and air-filled foam.

3. An antenna according to claim 1, wherein the side faces of the tube extend behind the front face a distance of at least λ/4, where λ is the designed operating wavelength of the antenna.

4. An antenna according to claim 1, comprising a plurality of the tubes arranged side-by-side and sharing the common parts of the outer surface which cover the side faces of the of the respective tubes.

5. An antenna according to claim 4, wherein the slots in each tube are divided into respective first and second sets wherein the sets have slots angled respectively at a first orientation and a second orientation different to the first orientation, relative to the axis of the tube, each set having a separate and electrically isolated feed network formed on the feed layer whereby the first set radiates in a first polarity and the second set radiates in a generally orthogonal second polarity.

6. An antenna according to claim 5 wherein the adjacent slots of adjacent tubes are at different polarisation angles.

7. An antenna according to claim 6, wherein the polarisation angles of the slots alternate across the tubes.

8. An antenna according to claim 4, wherein the first orientation is about +45 degrees and the second orientation is about −45 degrees.

9. An antenna according to claim 4, wherein the spacing between the radiating elements of respective tubes is approximately λ/2, where λ is the designed operating wavelength of the antenna.

10. An antenna according to claim 1, wherein the radiating elements are generally aligned along the axis of the tube and are spaced by about 0.8λ to λ along the axis of the tube, where λ is the designed operating wavelength of the antenna.

11. An antenna according to claim 1, wherein the length of each slot is about 0.5λ, where λ is the designed operating wavelength of the antenna.

12. An antenna according to claim 1, wherein each slot has a wider portion at each end forming a dogbone slot, whereby the length of each slot may be reduced.

13. An antenna according to claim 1, wherein the slots are angled at approximately 45 degrees to the axis of the tube.

14. An antenna according to claim 1, wherein the slots are divided into a first set and a second set and wherein the sets have slots angled respectively at a first orientation and a second orientation different to the first orientation relative to the axis of the tube, each set having a separate and electrically isolated feed network formed on the feed layer whereby the first set radiates in a first polarity and the second set radiates in a generally orthogonal second polarity.

15. An antenna according to claim 14, wherein the first orientation is about +45 degrees and the second orientation is about −45 degrees .

16. An antenna according to claim 14, wherein the slots of each set are offset from the axis of the tube by different respective distances.

17. An antenna according to claim 14, wherein the slots of the first and second sets generally overlap and are spaced apart by about 0.8λ along the axis of the tube, where λ is the designed operating wavelength of the antenna.

18. An antenna according to claim 14, wherein the slots of the first and second sets are interspersed and wherein the spacing between each element of a respective set is about 0.8λ along the axis of the tube, where λ is the designed operating wavelength of the antenna.

19. An antenna according to claim 18, wherein the slots are interspersed by selecting a slot from each respective set alternately along the length of the tube.

20. An antenna according to claim 19, wherein the tube is divided with conductive baffles arranged across the tube and located between slots of different sets.

21. An antenna according to claim 14, wherein the slots of each set are aligned on different respective axes along the tube.

22. An antenna according to claim 1, wherein the distal ends of the feed layer are shaped to form RF connectors for the attachment of feed cables.

23. An antenna according to claim 22, wherein the feed layer is formed from a plastics material and wherein the said RF connectors are formed by moulding and plating with an electrically conductive material.

24. An antenna according to claim 1, wherein the tube and/or the outer surface is formed from a plastics material with an electrically conductive coating.

25. An antenna according to claim 24, wherein the slots are formed by removing the electrically conductive coating whilst leaving at least part of the plastics material in place in the tube and/or outer surface.

26. An antenna according to claim 24 wherein the slots are formed by removing the electrically conductive coating and removing at least a portion of the underlying plastics material to form an aperture in the tube and/or outer surface.

27. An antenna according to claim 24, wherein the dielectric properties of the plastics material are used to tune the antenna by adjusting the thickness and contour of the plastics materials in the tube and/or outer surface.

28. An antenna according to claim 1, wherein the said outer surface forms a generally weather-proof radome.

29. An antenna according to claim 1, wherein the outer surface and/or the tube has a curved profile.

30. An antenna according to claim 1, designed for operation generally in the 2-5 GHz band and wherein the slot width is of the order of 0.07λ, where λ is the designed operating wavelength of the antenna.

31. An antenna according to claim 1, wherein said slot radiating element are fed using a T-bar feed.

32. A multibeam antenna comprising a generally cylindrical electrically conductive outer layer, a plurality of electrically conductive tubes arranged around the central axis of the cylinder, each electrically conductive tube forming a blocking cavity, an electrically conductive inner cylindrical layer forming the outermost wall of each tube, and a feed layer located between the inner and outer layers and arranged to carry electrically conductive tracks, and dielectric material located between the outer layer and the feed layer and between the inner layer and the feed layer;

the antenna further comprising a plurality of radiating elements, each radiating element being formed as a slot defined by an area of non-conductivity in the outer layer and an area of non-conductivity in the inner layer which are in registry with one another, the slot being energized in use by a conductive track defined on the feed layer which is generally in registry with the slot, whereby each tube generally corresponds to a single respective beam of the antenna.

33. An antenna according to claim 32, wherein the slots are angled at approximately 45 degrees to the axis of each respective tube.

34. An antenna according to claim 33, wherein the slots are divided into a first set and a second set each set having approximately equal numbers of slots to the other set and wherein the sets have slots angled respectively at a first orientation and a second orientation different to the first orientation relative to the axis of each respective tube, each set having a separate and electrically isolated feed network formed on the feed layer whereby the first set radiates in a first polarity and the second set radiates in a generally orthogonal second polarity.

35. An antenna according to claim 33, wherein the first orientation is about +45 degrees and the second orientation is about −45 degrees.

36. An antenna according to claim 33, wherein a plurality of tubes corresponds to a single respective beam of the antenna.

37. An antenna component comprising an electrically conductive tube forming a backing cavity, the electrically conductive tube including a front face and two side faces extending from the front face, an electrically conductive outer surface covering the front face of the tube and at least part of the two side faces of the tube, a feed layer located between the tube and the outer surface and arranged to carry electrically conductive tracks, and dielectric material located between the tube and the feed layer and between the outer surface and the feed layer;

the antenna further comprising a radiating element formed as a slot defined by areas of non-conductivity in the front face of the outer surface and in the tube which are in registry with one another, the slot being energized in use by a conductive track defined on the feed layer which is generally in registry with the slot.

38. A component according to claim 37, wherein one or both ends of the tube is substantially blocked with conductive material.

* * * * *